US005443556A

United States Patent [19]

Hasegawa et al.

[11] Patent Number: 5,443,556

[45] Date of Patent: Aug. 22, 1995

[54] METHOD AND APPARATUS FOR MOUNTING A MASTER PLATE ON A PRINTING DRUM HAVING AN INTEGRAL CUTTER

[75] Inventors: Takanori Hasegawa; Shoji Nonoyama, both of Tokyo, Japan

[73] Assignee: Riso Kagaku Corporation, Tokyo, Japan

[21] Appl. No.: 212,839

[22] Filed: Mar. 15, 1994

[30] Foreign Application Priority Data

Mar. 18, 1993 [JP] Japan ..... 5-058573

[51] Int. Cl.[6] ..... B41L 13/14

[52] U.S. Cl. ..... 101/116; 101/128.1; 101/477

[58] Field of Search ..... 101/114, 116, 117, 118, 101/127.1, 128.1, 129, 415.1, 477, 128.21, 128.4

[56] References Cited

U.S. PATENT DOCUMENTS

| | | | |
|---|---|---|---|
| 3,750,573 | 8/1973 | Haeusler et al. | 101/142 |
| 4,044,670 | 8/1977 | Maynard | 101/128.1 |
| 4,085,671 | 4/1978 | Gates et al. | 101/116 |
| 5,133,919 | 7/1992 | Hasegawa et al. | 101/114 |

FOREIGN PATENT DOCUMENTS

| | | | |
|---|---|---|---|
| 73987 | 4/1987 | Japan | 101/116 |
| 73988 | 4/1987 | Japan | 101/116 |

*Primary Examiner*—Edgar S. Burr
*Assistant Examiner*—Stephen R. Funk
*Attorney, Agent, or Firm*—Dickstein, Shapiro & Morin

[57] ABSTRACT

The present invention provides a printing drum for a rotary stencil printing device, comprising: a clamp for clamping a leading edge of a stencil master plate sheet along a line extending axially on an outer circumferential surface of the printing drum; and cutting device mounted on the printing drum for cutting the stencil master plate sheet to define a trailing edge of the stencil master plate sheet mounted on the printing drum. By thus providing the cutting device on the printing drum, the stencil master plate can be accurately cut because the cut length of the stencil master plate can be determined in relation with the circumferential length on the printing drum, and the cut edge of the stencil master plate can be made always exactly parallel to the axial line of the printing drum because there is no relative movement in the feeding direction between the stencil master plate sheet and the cutting device.

11 Claims, 5 Drawing Sheets

METHOD AND APPARATUS FOR MOUNTING A MASTER PLATE ON A PRINTING DRUM HAVING AN INTEGRAL CUTTER

TECHNICAL FIELD

The present invention relates to a printing drum and a method and device for mounting a stencil master plate sheet on a printing drum of a rotary stencil printing device in which a stencil master plate sheet typically supplied from a roll of continuous stencil master plate sheet is required to be wrapped around the outer circumferential surface of the printing drum.

BACKGROUND OF THE INVENTION

According to a conventional stencil printing device, a heat-sensitive stencil master plate sheet is paid off from a roll, and is thermally perforated into images to be printed. The thus perforated master plate sheet is conveyed to a printing drum, and is mounted around the outer circumferential surface of the printing drum by rotating the printing drum with the leading edge of the stencil master plate sheet clamped to the outer circumferential surface of the printing drum. When a prescribed length of the stencil master plate sheet is mounted on the printing drum, it is cut by a master plate cutter placed in a path for conveying the stencil master plate sheet to the printing drum. An example of a stencil printing device incorporated with such a feature is disclosed in Japanese utility model publication (kokoku) No. 4-18867.

According to such a stencil printing device, because the master plate cutting device is placed in an intermediate point of the path for conveying the stencil master plate sheet to the printing drum, the length of the path must be increased due to the presence of the master plate cutter. This obviously is undesirable in minimizing the size of the stencil printing device.

Furthermore, the conveying rollers for the stencil master plate sheet must be always in engagement with the stencil master plate sheet, but cannot be placed ahead or downstream of the cutter. Therefore, a substantial length of the leading edge of the stencil master plate sheet which was initially located upstream of the cutter must be pushed out and forwarded to the clamping position on the printing drum during the initial phase of mounting the stencil master plate 10 sheet on the printing drum, and this creates some difficulty in ensuring the process of mounting a stencil master plate sheet on the printing drum to be carried out successfully every time.

Additionally, depending on the timing of the actuation of the cutter in relation to the rotation of the printing drum, the length of the stencil master plate sheet mounted on the printing drum may fluctuate being either too long or too short as the case may be, and this fluctuation when excessive may cause some problem with the printing process.

If an attempt is made to cut the stencil master plate while the printing drum is rotating, the trailing edge of the cut stencil master plate sheet as well as the leading edge of the succeeding stencil master plate sheet may become slanted, and this causes some difficulty in properly clamping the leading edge of the stencil master plate sheet.

BRIEF SUMMARY OF THE INVENTION

In view of such problems of the prior art, a primary object of the present invention is to provide a printing drum which allows a trailing edge of a stencil master plate mounted on a printing drum to be cut in a proper manner even while the printing drum is rotating.

A second object of the present invention is to provide a printing drum which eliminates the need for presence of a cutting device in a path for conveying a stencil master plate to the printing drum and thus allows the overall stencil printing device to be made compact.

A third object of the present invention is to provide a printing drum which can minimize the time for mounting a stencil master plate sheet on the printing drum by allowing the trailing edge of the stencil master plate sheet to be cut without stopping the rotation of the printing drum. 10 A fourth object of the present invention is to provide a device and method for mounting a stencil master plate sheet on a printing drum which allows a stencil master plate to be mounted on the printing drum in a proper manner and to be cut into a prescribed length in an accurate manner at all times.

These and other objects of the present invention can be accomplished by providing a printing drum for a rotary stencil printing device, comprising: clamping means for clamping a leading edge of a stencil master plate sheet along a line extending axially on an outer circumferential surface of the printing drum; and cutting means mounted on the printing drum for cutting the stencil master plate sheet to define a trailing edge of the stencil master plate sheet mounted on the printing drum.

By thus providing the cutting means on the printing drum, the stencil master plate can be accurately cut because the cut length of the stencil master plate can be determined in relation with the circumferential length on the printing drum, and the cut edge of the stencil master plate can be made always exactly parallel to the axial line of the printing drum because there is no relative movement in the feeding direction between the stencil master plate sheet and the cutting means.

Preferably, the cutting means comprises a cutter comprising a cutter member, and means for moving the cutter member along an axially extending line on the outer circumferential surface of the printing drum.

According to a preferred embodiment of the present invention, the cutter member comprises a cutting blade which is guided for an axial movement in a slit defined in a guide rail extending along an axial line on the outer circumferential surface of the printing drum, and the cutting blade is carried by a carriage which is guided for an axial movement substantially over an entire length of the printing drum by the guide rail.

The cutting member may be axially moved by suitable power means mounted on the printing drum, and a combination of a wire and pulleys mounted on the printing drum. If the carriage carries a pair of cutting blades on front and rear ends thereof, respectively, so that the stencil master plate may be cut as the carriage is moved in either direction by a corresponding one of the cutting blades, the cutter member is only required to move from one end of the printing drum to another for each cycle of mounting a stencil master plate on the printing drum. Thus, the cutter member is not needed to be returned to the original position for each cycle, and the mounting of a stencil master plate on the printing drum can be completed more quickly.

The present invention further provides a method for mounting a stencil master plate sheet around a printing drum, comprising the steps of: engaging a leading edge of a continuous stencil master plate sheet fed from a stencil master plate feeding means on an outer circumferential surface of the printing drum; rotating the printing drum; applying a certain tension to the stencil master plate sheet as it is wrapped around the rotating printing drum; and cutting the stencil master plate sheet with cutting means provided on the printing drum so as to define a trailing edge of the stencil master plate sheet mounted on the printing drum.

Thus, the stencil master plate sheet can be cut to define a trailing edge thereof while the printing drum is rotating, and the time required for mounting a stencil master plate on the printing drum can be reduced. This cutting process can be particularly favorably carried if some tension is present in the stencil master plate sheet, and there is no slacking in the stencil master plate sheet.

The tension can be applied to the stencil printing device, for instance, by selecting a nominal circumferential speed of the printing drum to be slightly faster than a speed of feeding the stencil master plate sheet from the stencil master plate sheet feeding means. To place the leading edge of the stencil master plate sheet which is to be mounted on the printing drum in the next cycle, a part of the stencil master plate sheet on the side of the stencil master plate feeding means may be slightly retracted immediately after cutting the stencil master plate sheet to define a trailing edge with the cutting means.

The method of the present invention can be conveniently implemented with a device for mounting a stencil master plate sheet around a printing drum of a rotary stencil printing device, comprising: a printing drum rotatably supported by a printing device main body; clamping means mounted on the printing drum for clamping a leading edge of the stencil master plate sheet; rotating means for rotating the printing drum for wrapping the stencil master plate sheet around an outer circumferential surface of the printing drum; and stencil master plate sheet supplying means for feeding a stencil master plate to the printing drum, and applying a tension to the stencil master plate sheet as it is wrapped around the printing drum; and stencil master plate cutting means provided on the printing drum to cut the stencil master plate upon completion of mounting the stencil printing device by a prescribed length to define a trailing edge of the stencil master plate sheet mounted on the printing drum.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
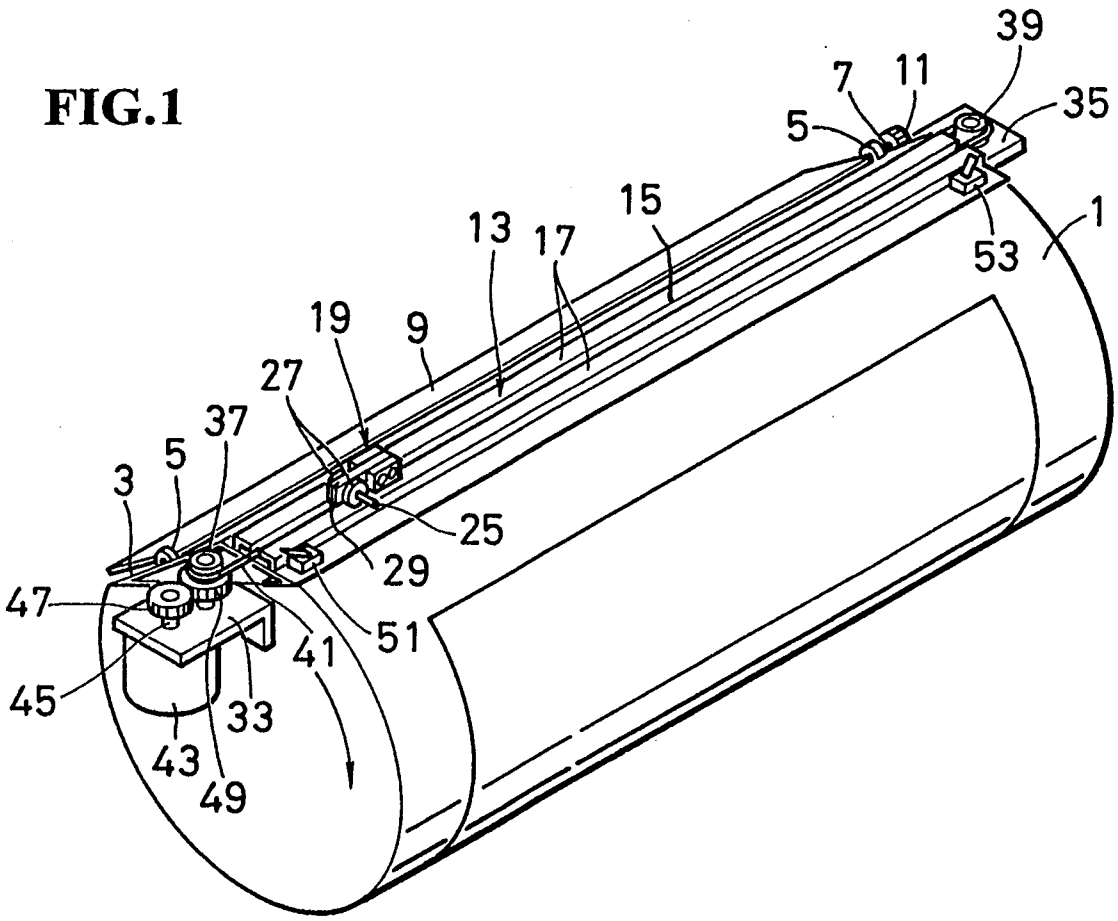
FIG. 1 is a perspective view of an embodiment of the printing drum for stencil printing according to the present invention.
Figure 2:
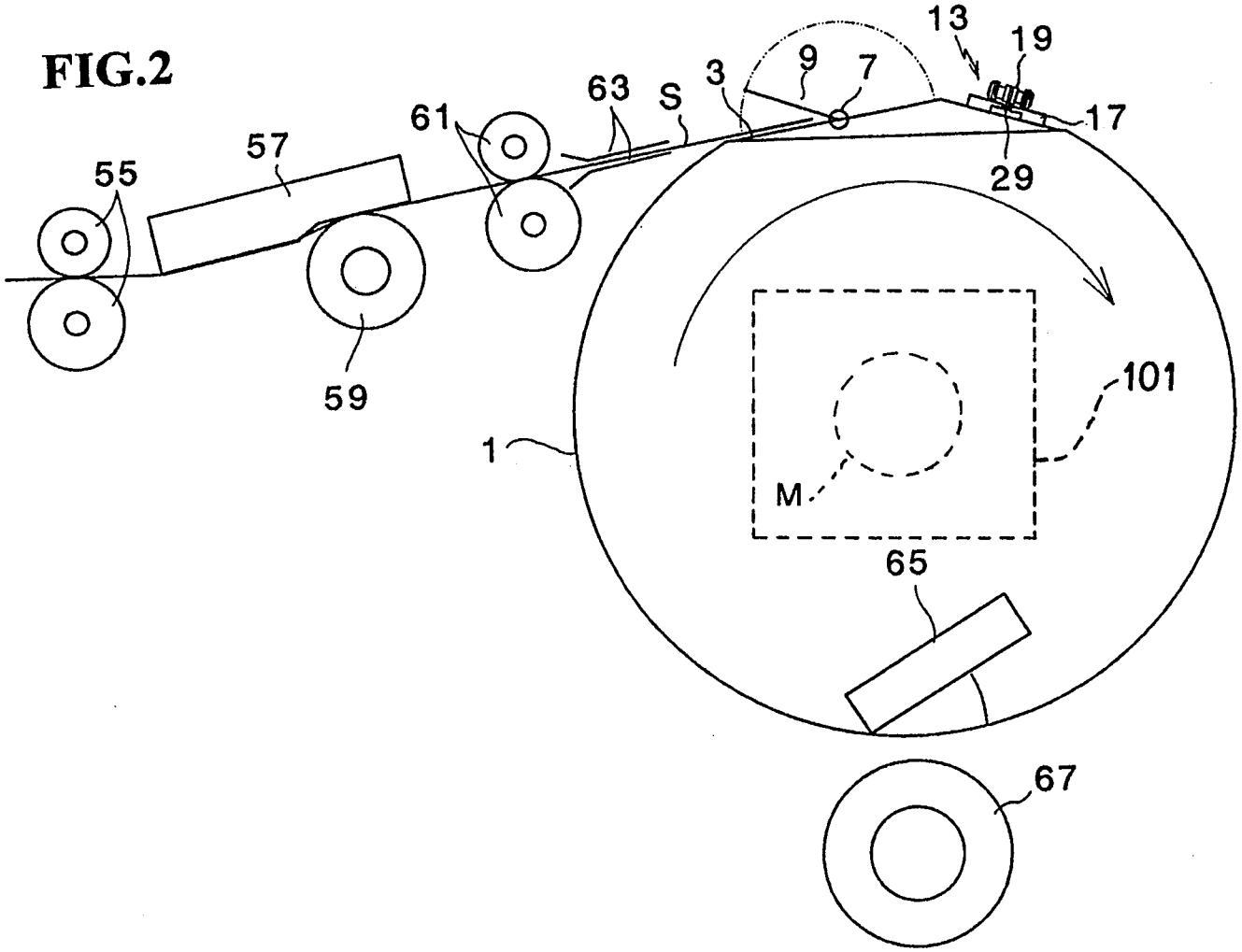
FIG. 2 is a schematic side view of a stencil printing device equipped with the printing drum of the present invention at an initial part of the process mounting a stencil master plate on the printing drum.
Figure 3:
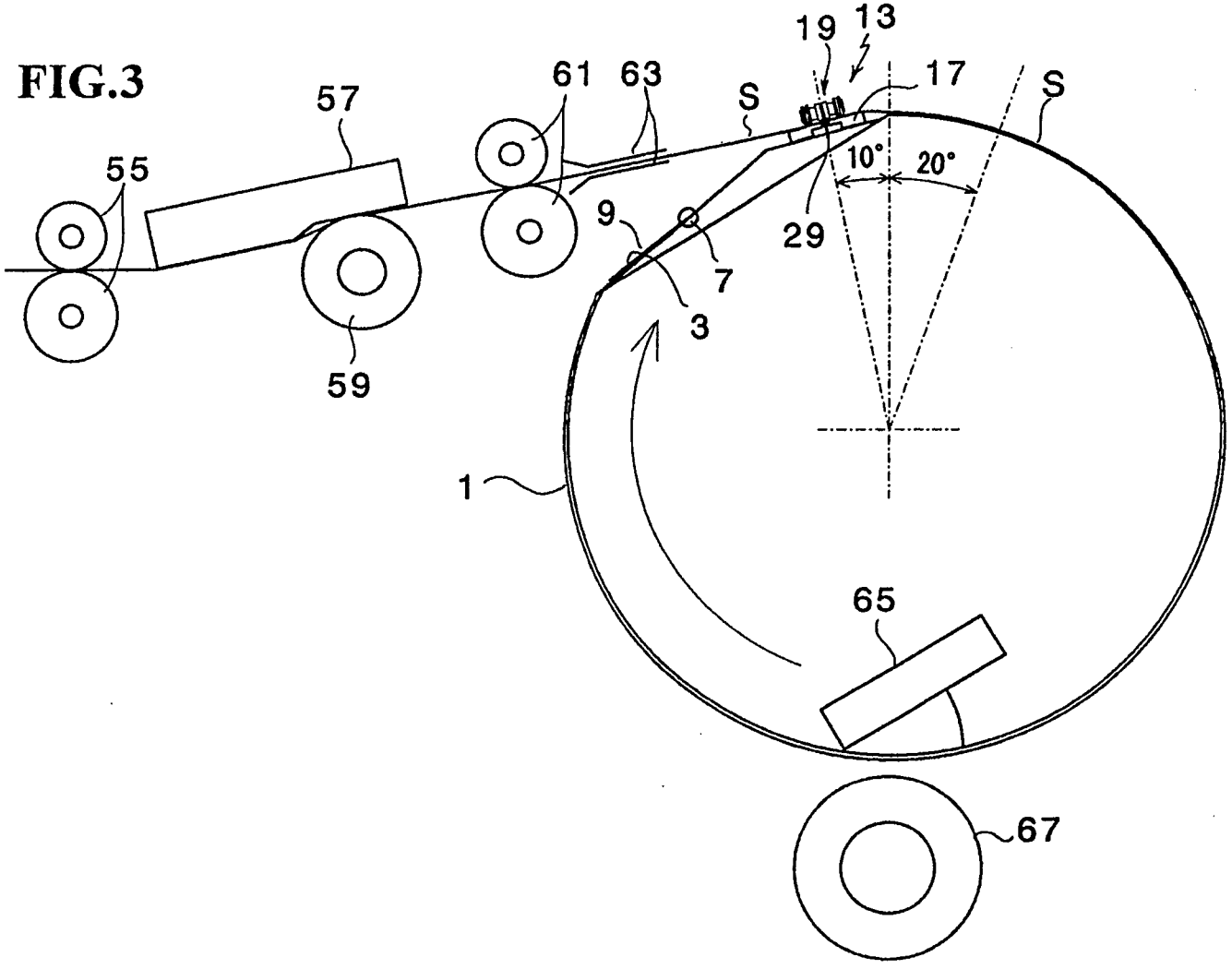
FIG. 3 is a schematic side view of the stencil printing device equipped with the printing drum of the present invention at a final part of the process of mounting a stencil master plate on the printing drum in which the stencil master plate is about to be cut apart.

FIGS. 1 through 6 show a stencil printing device equipped with a printing drum according to the present invention, and is adapted to implement the method of the present invention. In these drawings, numeral 1 denotes a cylindrical printing drum for stencil printing which is rotatably supported by a support structure not shown in the drawings, and is rotatively driven in clockwise direction as seen in FIGS. 1 through 3 around its axial center line.

A part of the outer circumferential surface of the printing drum 1 is provided with a flat portion 3 extending in the axial direction for clamping leading and trailing edges of a stencil master plate. Two axial ends of the flat portion 3 are provided with bearing brackets 5, and a master plate clamp plate 9 consisting of an axially extending elongated plate is pivotally supported by the bearing brackets 5 by way of a pivot shaft 7 between a master plate clamping position and a master plate unclamping position which is angularly displaced-from the clamping position by approximately 180 degrees in clockwise direction as seen in FIGS. 1 through 3.

An end of the pivot shaft 7 is provided with a gear 11 which meshes with a gear of a clamp plate drive motor not shown in the drawings for rotatively driving the clamp plate 9.

A part of the outer circumferential surface of the printing drum 1 adjacent to the master plate clamping structure is provided with a master plate cutting device 13 which comprises a guide rail 17 fixedly secured to the outer circumferential surface of the printing drum 1 and extends in the axial direction of the printing drum 1 with an axial slit portion 15 defined therein substantially over its entire length, and a moveable cutter assembly 19 which can reciprocate in the axial direction of the printing drum 1 over its entire length guided by the guide rail 17.

Figure 4:
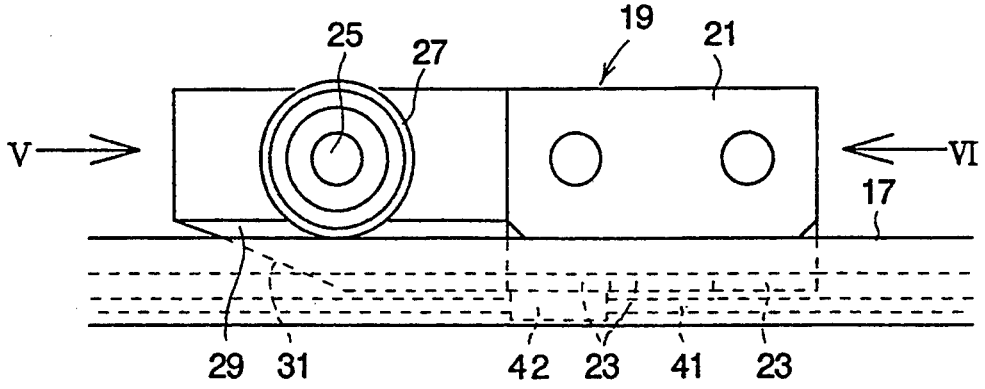
FIG. 4 is a schematic side view showing an embodiment of the master plate cutting device according to the present invention.
Figure 5:
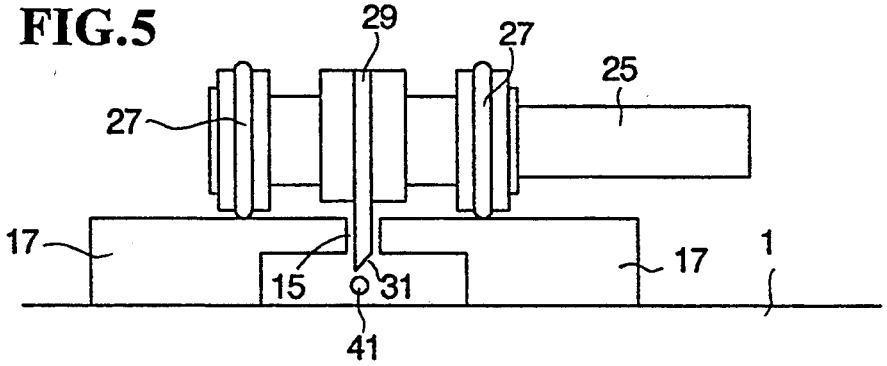
FIG. 5 is an end view seen from the direction indicated by V in FIG. 4.
Figure 6:
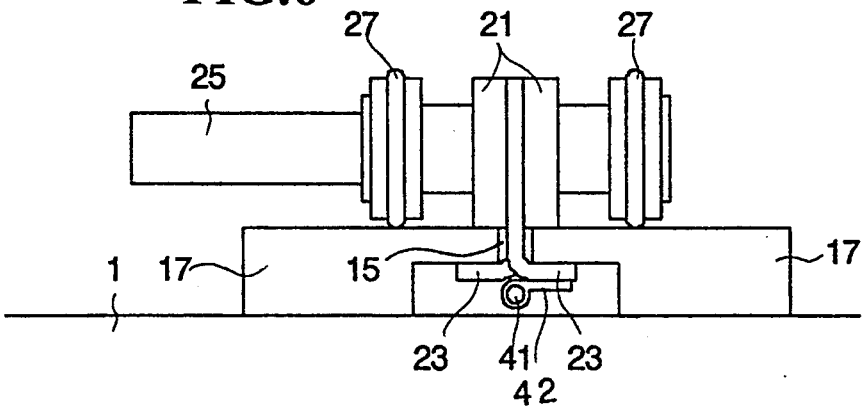
FIG. 6 is an end view seen from .the direction indicated by VI in FIG. 4.

Referring to FIG. 4, the moveable cutter assembly or carriage 19 comprises engagement plates 21 and 23 to keep the assembly slidably engaged by the guide rail 17, a pair of wheels 27 rotatably supported by a wheel shaft 25 to allow the assembly to travel in the axial direction of the printing drum 1 substantially without any friction guided by the guide rail 17, and a cutter 29 (as shown in broken line) for cutting the stencil master plate. The cutter 29 is provided with a cutting edge 31 substantially opposing the outer circumferential surface of the printing drum 1 and defining an oblique angle with respect to the axial direction of the printing drum 1, and extends from a position above the guide rail 17 into the slit portion 15 of the guide rail 17.

Again, referring to FIG. 1, brackets 33 and 35 are fixedly mounted on either axial end of the printing drum 1, and rotatably support pulleys 37 and 39, respectively. The rotational center lines of these pulleys 37 and 39 extend perpendicularly to the axial line of the printing drum 1. An endless wire 41 is passed around the pulleys 37 and 39, and can travel in the axial direction between the two pulleys 37 and 39. The wire 41 is driveably engaged with the moveable cutter assembly 19 by a connecting member 42. The bracket 33 is provided with a cutter drive motor 43, and a gear 47 mounted on an output shaft 45 of the cutter drive motor 43 meshes with a gear 49 coaxially mounted on the pulley 37 to rotatively drive the pulley 37.

An end of the wheel shaft 25 extends laterally from the moveable cutter assembly 19, and this extended part of the wheel shaft 25 activates limit switches 51 and 53 provided on either axial end of the printing drum 1. These limit switches 51 and 53 detect the arrival of the moveable cutter assembly 19 at each terminal point of its axial movement, and turn on and off and reverse the electric power supplied to the cutter drive motor 43 as required.

The supply of electric power to the cutter drive motor 43 may be carried out either externally by way of a brush and slip ring not shown in the drawings or internally by a battery installed in the printing drum 1. Alternatively, the electric power for driving the cutter drive motor 43 may be derived from an electric generator, preferably combined with a battery, which produces electric power by being powered by the rotation of the printing drum 1.

As shown in FIGS. 2 and 3, a pair of master plate loading rollers 55, a thermal head 57 for thermal plate making, a platen roller 59, a pair of master plate loading rollers 61, and a pair of master plate guide members 63 are provided on one side of the printing drum 1. The master plate loading rollers 55 interpose the heat-sensitive stencil master plate sheet S between them, and feed the master plate sheet S while applying a certain resistance to the master plate sheet S as it is fed toward the printing drum.

In this case, the feeding path of the heat-sensitive stencil master plate sheet S defines a climbing angle of approximately 10 degrees with respect to a horizontal plane, and aligns with the upper surface of the flat portion 3 when the printing drum 1 is at its position for clamping the master plate sheet S as shown in FIG. 2. In FIGS. 2 and 3, numeral 65 denotes a squeegee blade engaging with the inner circumferential surface of the printing drum 1, numeral 101 denotes a means for rotating drum 1, and numeral 67 denotes a press roller.

Now the process of mounting a stencil master plate on the printing drum 1 is described in the following with respect to the stencil printing device described above.

The master plate loading rollers 55, the platen roller 59 and the master plate loading rollers 61 are driven in the normal direction, and a heat-sensitive stencil master plate sheet S is perforated by the thermal head 57 according to the images to be printed as it is delivered toward the printing drum 1. Referring to FIG. 2, with the printing drum 1 placed at its position for clamping a master plate, the leading edge of the heat-sensitive stencil master plate sheet S is forwarded to the flat portion 3 of the printing drum 1 guided by the master plate guide members 63.

Upon arrival of the leading edge of the heat-sensitive stencil master plate sheet S, the clamp plate 9 which was initially at its unclamping position is driven into its clamping position so that the leading edge of the heat-sensitive stencil master plate sheet S is engaged to the printing drum 1 by being clamped between the flat portion 3 and the clamp plate 9.

Upon completion of the clamping of the leading edge of the stencil master plate, the printing drum 1 is rotatively driven in clockwise direction as seen in FIGS. 1 though 3 (around, for example, shaft M ash shown in FIG. 2). The rotational speed of the printing drum 1 is selected so that the circumferential speed of the printing drum 1 is slightly greater than the feeding speed of the heat-sensitive stencil master plate sheet S by the master plate loading rollers 61. As a result, some tension is applied to the heat-sensitive stencil master plate sheet S between the master plate loading rollers 61 and the printing drum 1 while the stencil master plate sheet S is wrapped around the outer circumferential surface of the printing drum 1 as it rotates.

As the stencil master plate sheet S is wrapped around the outer circumferential surface of the printing drum 1, the printing drum 1 rotates to a position in which the master plate cutting device 13 is 10 degrees behind an uppermost position on the printing drum 1 as illustrated in FIG. 3. At this point, the stencil master plate sheet S is also wrapped around the guide rail 17, and the cutter drive motor 43 is then activated. As a result, the moveable cutter assembly 19 which was at one of its stroke ends adjacent to the limit switch 53 travels leftward as seen in FIG. 1 guided by the guide rail 17, and this movement of the cutter assembly 19 causes the stencil master plate sheet S placed under tension to be severed by the cutting edge 31 of the stencil master plate cutter 29.

This cutting process of the stencil master plate sheet S can be carried out even while the printing drum 1 is being rotated. It suffices if the stencil master plate sheet is cut by the master plate sheet cutting device 13 between the position at which the master plate cutting device 13 is located at the upper end of the printing drum 1 and the position at which the cutting device has advanced from its uppermost position by approximately 20 degrees.

When the moveable cutter assembly 19 has moved over the length of the printing drum 1, the stencil master plate S is completely cut apart, and the cutter drive motor 43 is then reversed for moving the moveable cutter assembly 19 back to its initial position to place it ready for the next cutting process. The arrival of the moveable cutter assembly 19 at an end of its cutting stroke is detected by the limit switch 51, and the arrival of the moveable cutter assembly 19 at an end of its returning stroke is detected by the limit switch 53. This completes the process of mounting stencil master plate sheet S on the printing drum 1.

After cutting apart the stencil master plate sheet, the stencil master plate sheet on the side of the master plate loading rollers 61 is slightly pulled back, however, without being disengaged from the nip between the master plate loading rollers 61 by being 10 driven in the reverse direction by the master plate loading rollers 55, the platen roller 59, and the master plate loading rollers 61. If the stencil master plate sheet S is supplied from a master plate sheet roller, such a pulling back movement may be achieved by a slight reverse rotation of the stencil master plate sheet roll.

Figure 7:
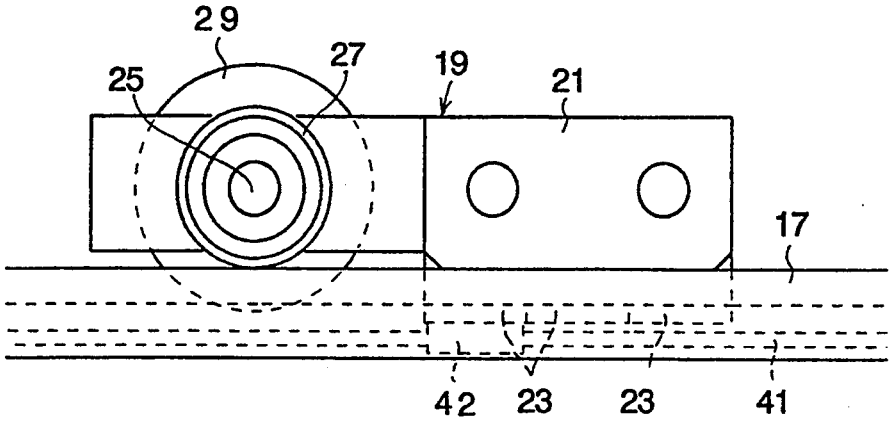
FIG. 7 is a schematic side view showing a second embodiment of the master plate cutting device according to the present invention.

In the above described embodiment, the cutter 29 for severing the stencil master plate sheet consisted of an oblique cutting edge 31, but may also be a disk-shaped rotary cutting blade 29 as illustrated in FIG. 7.

Figure 8:
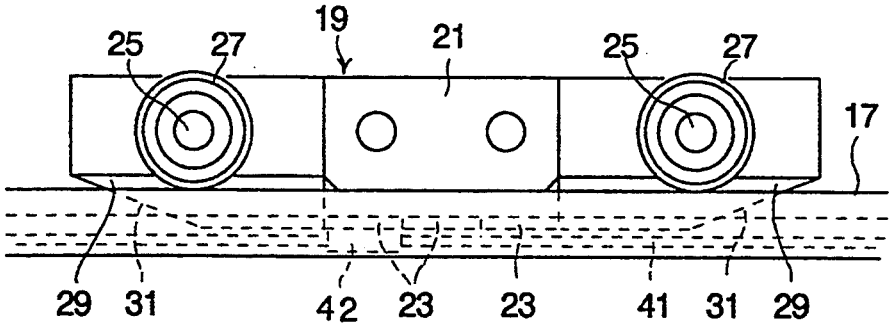
FIG. 8 is a schematic side view showing a third embodiment of the master plate cutting device according to the present invention.

Also, as illustrated in FIG. 8, the moveable cutter assembly 19 may be provided with two sets of cutters 29 (as shown in broken line) on either axial end thereof so that the moveable cutting assembly 19 may be capable of cutting the stencil master plate sheet in its movement of either direction. Thus, according to this embodiment, it is not necessary to return the moveable cutter assembly 19 to its initial position upon completion of each cutting stroke.

Although the present invention has been described in terms of a specific embodiment thereof, it is possible to modify and alter details thereof without departing from the spirit of the present invention.

What we claim is:

1. A printing drum for a rotary stencil printing device, comprising:

clamping means for clamping a leading edge of a stencil master plate sheet along a line extending axially on an outer circumferential surface of said printing drum before said stencil master sheet is wrapped around said outer circumferential surface of said printing drum; and cutting means mounted on said outer surface of said printing drum for cutting said stencil master plate sheet to define a trailing edge of said stencil master plate sheet mounted on said printing drum as said stencil master plate sheet is mounted on said drum.

2. A printing drum for a rotary stencil printing device, comprising:

clamping means for clamping a leading edge of a stencil master plate sheet along a line extending axially on an outer circumferential surface of said printing drum; and cutting means mounted on said printing drum for cutting said stencil master plate sheet to define a trailing edge of said stencil master plate sheet mounted on said printing drum, said cutting means comprising a cutter member, and means for moving said cutter member along an axially extending line on said outer circumferential surface of said printing drum.

3. A printing drum according to claim 2, wherein said cutter member comprises a cutting blade which is guided for an axial movement in a slit defined in a guide rail extending along an axial line on said outer circumferential surface of said printing drum.

4. A printing drum according to claim 3, wherein said cutting blade is carried by a carriage which is guided for an axial movement substantially over an entire length of said printing drum by said guide rail.

5. A printing drum according to claim 4, further comprising power means for moving said carriage along said guide rail in either direction.

6. A printing drum according to claim 5, wherein said carriage carries a pair of cutting blades on front and rear ends thereof, respectively, so that said stencil master plate may be cut as said carriage is moved in either direction by a corresponding one of said cutting blades.

7. A method for mounting a stencil master plate sheet around a printing drum, comprising the steps of:

engaging a leading edge of a continuous stencil master plate sheet fed from a stencil master plate feeding means on an outer circumferential surface of said printing drum before said stencil master sheet is wrapped around said outer circumferential surface of said printing drum;

rotating said printing drum;

applying a certain tension to said stencil master plate sheet as it is wrapped around said rotating printing drum; and cutting said stencil master plate with cutting means provided on said outer surface of said printing drum so as to define a trailing edge of said stencil master plate sheet mounted on said printing drum as said stencil master plate sheet is mounted on said printing drum.

8. A method according to claim 7, wherein said stencil master plate sheet is cut to define said trailing edge thereof while said printing drum is rotating.

9. A method for mounting a stencil master plate sheet around a printing drum, comprising the steps of:

engaging a leading edge of a continuous stencil master plate sheet fed from a stencil master plate feeding means on an outer circumferential surface of said printing drum before said stencil master sheet is wrapped around said outer circumferential surface of said printing drum;

rotating said printing drum;

applying a certain tension to said stencil master plate sheet as it is wrapped around said rotating printing drum; and cutting said stencil master plate sheet with cutting means provided on said printing drum so as to define a trailing edge of said stencil master plate sheet mounted on said printing drum, wherein said tension is applied to said stencil printing device by selecting a nominal circumferential speed of said printing drum to be slightly faster than a speed of feeding said stencil master plate sheet from said stencil master plate sheet feeding means.

10. A method for mounting a stencil master plate sheet around a printing drum, comprising the steps of:

engaging a leading edge of a continuous stencil master plate sheet fed from a stencil master plate feeding means on an outer circumferential surface of said printing drum before said stencil master sheet is wrapped around said outer circumferential surface of said printing drum;

rotating said printing drum;

applying a certain tension to said stencil master plate sheet as it is wrapped around said rotating printing drum; and cutting said stencil master plate sheet with cutting means provided on said printing drum so as to define a trailing edge of said stencil master plate sheet mounted on said printing drum, and slightly retracting a part of said stencil master plate sheet on a side of said stencil master plate feeding means immediately after cutting said stencil master plate sheet to define said trailing edge with said cutting means.

11. A device for mounting a stencil master plate sheet around a printing drum of a rotary stencil printing device, comprising:

a printing drum;

clamping means mounted on said printing drum for clamping a leading edge of said stencil master plate sheet before said stencil master sheet is wrapped around said outer circumferential surface of said printing drum;

rotating means for rotating said printing drum for wrapping said stencil master plate sheet around an outer circumferencial surface of said printing drum;

stencil master plate sheet feeding means for feeding said stencil master plate sheet to said printing drum, and applying a tension to said stencil master plate sheet as it is wrapped around said printing drum; and stencil master plate cutting means provided on said outer circumferential surface of said printing drum for cutting said stencil master plate sheet by a prescribed length to define a trailing edge of said stencil master plate sheet as said stencil master plate sheet is mounted on said printing drum.

* * * * *